US008551265B2

(12) United States Patent
Ishida et al.

(10) Patent No.: US 8,551,265 B2
(45) Date of Patent: Oct. 8, 2013

(54) COBALT-BASE ALLOY WITH HIGH HEAT RESISTANCE AND HIGH STRENGTH AND PROCESS FOR PRODUCING THE SAME

(75) Inventors: Kiyohito Ishida, Sendai (JP); Ryosuke Kainuma, Natori (JP); Katunari Oikawa, Sendai (JP); Ikuo Ohnuma, Sendai (JP); Jun Sato, Sendai (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 622 days.

(21) Appl. No.: 12/036,880

(22) Filed: Feb. 25, 2008

(65) Prior Publication Data

US 2008/0185078 A1 Aug. 7, 2008

Related U.S. Application Data

(63) Continuation of application No. PCT/JP2006/317939, filed on Sep. 5, 2006.

(30) Foreign Application Priority Data

Sep. 15, 2005 (JP) ..... 2005-267964

(51) Int. Cl.
*C22C 19/07* (2006.01)

(52) U.S. Cl.
USPC ..... 148/674; 148/408; 148/538

(58) Field of Classification Search
USPC ..... 148/408.674, 425, 538; 420/436, 420/437, 438, 439, 440
See application file for complete search history.

(56) References Cited

U.S. PATENT DOCUMENTS

| | | | | |
|---|---|---|---|---|
| 3,960,552 | A | 6/1976 | Woulds | |
| 4,082,548 | A | 4/1978 | Kleemann et al. | |
| 4,152,181 | A | 5/1979 | Hirakis | |
| 4,606,887 | A | 8/1986 | Hausselt et al. | |
| 4,765,955 | A | 8/1988 | Yabuki et al. | |
| 2008/0185075 | A1 * | 8/2008 | Ishida et al. | 148/538 |
| 2008/0206090 | A1 * | 8/2008 | Ishida et al. | 420/461 |

FOREIGN PATENT DOCUMENTS

| | | | |
|---|---|---|---|
| JP | 59-129746 | A | 7/1984 |
| JP | 10-102175 | A | 4/1998 |
| JP | 2004-238720 | * | 8/2004 |

OTHER PUBLICATIONS

H. Chinen et al. New ternary compound Co3(Ge,W) with L12 structure. Scripta Materialia, vol. 56, (2007), p. 141-143.*

D.H. Ping et al. Microstructure of a newly developed γ' strengthened Co-base superalloy. Ultramicroscopy. vol. 107, (2007), p. 791-795.*

(Continued)

*Primary Examiner* — Jie Yang
(74) *Attorney, Agent, or Firm* — Westerman, Hattori, Daniels & Adrian, LLP

(57) ABSTRACT

A Co-base alloy which has a basic composition including, in terms of mass proportion, 0.1%-10% Al, 3.0-45% W, and Co as the remainder and has an intermetallic compound of the $L1_2$ type $[Co_3(Al,W)]$ dispersed and precipitated therein. Part of the Co may be replaced with Ni, Ir, Fe, Cr, Re, or Ru, while part of the Al and W may be replaced with Ni, Ti, Nb, Zr, V, Ta or Hf. The intermetallic compound $[Co_3(Al, W)]$ has a high melting point, and this compound and the matrix are mismatched little with respect to lattice constant. Thus, the cobalt-base alloy can have high-temperature strength equal to that of nickel-base alloys and excellent structure stability.

8 Claims, 12 Drawing Sheets

(56) References Cited

OTHER PUBLICATIONS

J. Sato et al. Cobalt-base high-temperature alloys, Science, vol. 312, (2006), p. 90-93.*
A. Suzuki et al. Flow stress anomalies in γ/ γ' two-phase Co-Al-W base alloys, Scripta Materialia, vol. 56, (2007), p. 385-388.*
Q. Yao et al. Structural stability and elastic property of the L12 ordered Co3(Al,W) precipitate, Applied Physics Letters, vol. 89, (2006), p. 161906-(1-3).*
C. C Jiang. First principles study of Co3(Al,W) alloys using special quasi-random structures. Scripta Materialia, vol. 59, (2008), p. 1075-1078.*
English translation of Ishida—JP 2004-238720 A, published Aug. 26, 2004, 24 pages total.*
International Search Report of PCT/JP2006/317939, date of mailing Oct. 17, 2006.

* cited by examiner

Test No. 6
Co-3.7Al-24.6W(% by mass)
900°C; 1 hour aging
Stress (Mpa)
1200
800
400
0
0
5
10
15
20
25
Strain (%)

Aging time: 168 hours

Vickers hardness (HV)
500
400
300
200
RT
500
600
700
800
900
1000
Aging time (hours)
■ Alloy No. 3
○ Co-8.02Cr-10.41Ta ( % by mass
□ Waspaloy Alloy No. 3
Aging temperature
Vickers hardness (HV)
600
500
400
300
200
100
0
50
100
150
Aging time (hours)

Solidus temperature
γ
γ' phase solid solution temperature
γ + γ'
Temperature (°C)
1500
1400
1300
1200
1100
1000
0
20
40
60
Amount of Ni (% by mass)

COBALT-BASE ALLOY WITH HIGH HEAT RESISTANCE AND HIGH STRENGTH AND PROCESS FOR PRODUCING THE SAME

TECHNICAL FIELD

The present invention relates to a Co-base alloy suitable for applications where a high temperature strength is required or applications where a high strength and a high elasticity are required and process for producing the same.

BACKGROUND ART

With reference to gas turbine members, engine members for aircraft, chemical plant materials, engine members for automobile such as turbocharger rotors, and high temperature furnace materials etc., the strength is needed under a high temperature environment and an excellent oxidation resistance is sometimes required. For that reason, a Ni-base alloy and Co-base alloy have been used for such a high-temperature application. For example, as atypical heat-resistant material such as a turbine blade, a Ni-base superalloy which is strengthened by the formation of γ' phase having an $Ll_2$ structure: $Ni_3(Al,Ti)$ is listed. It is preferable that the γ' phase is used to highly strengthen heat-resistant materials because it has an inverse temperature dependence in which the strength becomes higher with rising temperature.

In the high-temperature application where the corrosion resistance and ductility are required, a commonly used alloy is the Co-base alloy rather than the Ni-base alloy. The Co-base alloy is highly strengthened with $M_{23}C_6$ or MC type carbide. $Co_3Ti$ and $Co_3Ta$ etc. which have the same $Ll_2$-type structure as the crystal structure of the γ' phase of the Ni-base alloy have been reported as strengthening phases. However, $Co_3Ti$ has a low melting point and $Co_3Ta$ has a low stability at high temperature. Thus, in the case of using materials made with $Co_3Ti$ and $Co_3Ta$ as strengthening phases, the upper limit of the operating temperature is only about 750° C. even when alloy elements are added. A process including steps of: adding Ni, Al, and Ti etc., precipitating, and strengthening with the γ' phase [$Ni_3(Al,Ti)$] has been reported in Japanese Patent Application Laid-Open (JP-A) No. 59-129746, however, a significant strengthening equal to that of the Ni-base alloy has not been obtained. A process for precipitating and strengthening by using $Co_3AlC$ phase having an $E2_1$-type intermetallic compound, which has the crystal structure similar to the γ' phase (JP-A No. 10-102175) has also been examined. However, it has not yet been put to practical use.

DISCLOSURE OF THE INVENTION

The present inventors investigated and examined various precipitates which are effective in strengthening the Co-base alloy. As a result, the present inventor discovered a ternary compound $Co_3(Al,W)$ having the $Ll_2$ structure and found that the ternary compound was an effective factor in strengthening the cobalt-base alloy. The $Co_3(Al,W)$ has the same crystal structure as a $Ni_3Al$ (γ') phase, which is a major strengthening phase of the Ni-base alloy and has a good compatibility with the matrix. Further, it contributes to the high strengthening of the alloy since it can be precipitated uniformly and finely.

An objective of the present invention is to provide a Co-base alloy with heat resistance equal to that of the conventional Ni-base alloys and an excellent textural stability which is obtained by precipitating and dispersing the $Co_3(Al,W)$ having a high melting point to highly strengthen on the basis of the findings.

The Co-base alloy of the present invention has a basic composition which includes, in terms of mass proportion, 0.1 to 10% of Al, 3.0 to 45% of W, and Co as the substantial remainder and, if necessary, contains one or more alloy components selected from Group (I) and/or Group (II). In this regard, when alloy components of Group (I) are added, the total content is selected from the range of 0.001 to 2.0%. When alloy components of Group (II) are added, the total content is selected from the range of 0.1 to 50%.

Group (I): 0.001 to 1% of B, 0.001 to 2.0% of C, 0.01 to 1.0% of Y, and 0.01 to 1.0% of La or misch metal Group (II): 50% or less of Ni, 50% or less of Ir, 10% or less of Fe, 20% or less of Cr, 15% or less of Mo, 10% or less of Re, 10% or less of Ru, 10% or less of Ti, 20% or less of Nb, 10% or less of Zr, 10% or less of V, and 20% or less of Ta, 10% or less of Hf The Co-base alloy has a two-phase (γ+γ') texture in which an intermetallic compound of the $Ll_2$-type [$Co_3(Al,W)$] is precipitated on the matrix. In a component system to which an alloy component of Group (II) is added, the $Ll_2$-type intermetallic compound is represented by $(Co,X)_3(Al,W,Z)$. Wherein, X is Ir, Fe, Cr, Re, and/or Ru, Z is Mo, Ti, Nb, Zr, V, Ta, and/or Hf, and nickel is included in both X and Z. Further, a numerical subscript shows atom ratio of each element.

The intermetallic compound [$Co_3(Al,W)$] or [$(Co,X)_3(Al,W,Z)$] is precipitated by performing an aging treatment in the range of 500 to 1100° C. after the solution treatment of the Co-base alloy that is adjusted to a predetermined composition at 1100 to 1400° C. The aging treatment is repeatedly performed at least once or more.

BEST MODE FOR CARRYING OUT THE INVENTION

Figure 1:
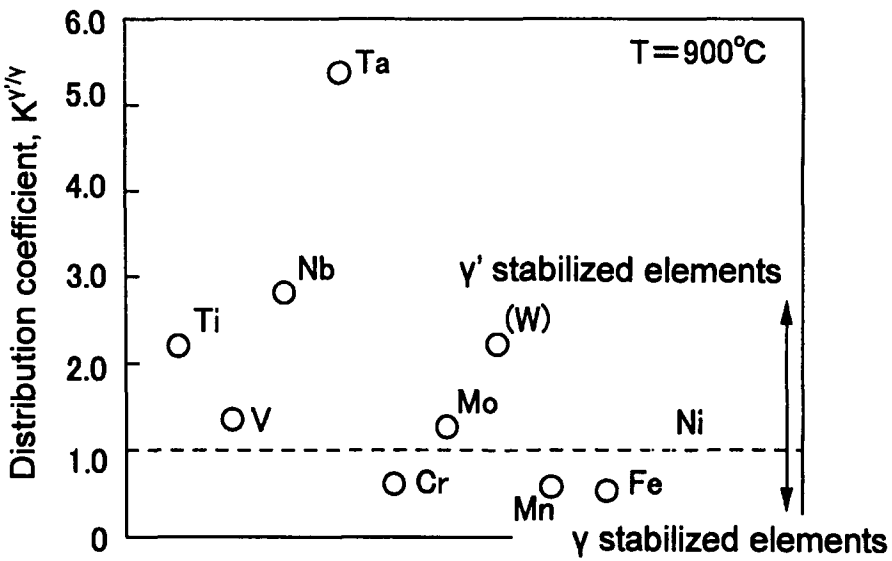
FIG. 1 is a graph showing the distribution coefficient of each element in the matrix and γ' phase.

The Co-base alloy of the present invention has a melting point from about 50 to 100° C., which is higher than that of the Ni-base alloy generally used, and the diffusion coefficient of substitutional element is smaller than Ni-base. Therefore, there is only a slight change in texture when the Co-base alloy is used at high temperature. Further, the deformation processing of the Co-base alloy can be performed by forging, rolling, pressing, and the like since it is rich in ductility as compared with the Ni-base alloy. Thus, it can be expected to put into wide application as compared with the Ni-base alloy.

The mismatch of the lattice constant between the γ' phase of $Co_3Ti$ and $Co_3Ta$ which are conventionally used as strengthening phases and γ matrix is 1% or more, which is disadvantageous from the point of view of creep resistance. On the other hand, the mismatch between the intermetallic compound [$Co_3$(Al,W)] which is used as a strengthening phase in the present invention and the matrix is up to about 0.5%, and has a textural stability exceeding that of the Ni-base alloy which is precipitated and strengthened with the γ' phase.

Further, when the intermetallic compound is compared with 200 GPa of the Ni-base alloy, the elastic coefficient is 10% or more (220 to 230 GPa). Thus, the intermetallic compound can be used in applications where the high strength and the high elasticity are required, for example, spiral springs, springs, wires, belts, and cable guides. Since the intermetallic compound is hard and excellent in abrasion resistance and corrosion resistance, it can also be used as a build-up material.

It is preferable that the intermetallic compound of the $Ll_2$-type [$Co_3$(Al,W)] or [$(Co,X)_3$(Al,W,Z)] is precipitated under conditions where the precipitate's particle diameter is 1 μm or less and volume fraction is about 40 to 85%. When the particle diameter exceeds 1 μm, the mechanical properties such as strength and hardness is easily deteriorated. When the precipitation amount is less than 40%, the strengthening is insufficient. On the other hand, when the precipitation amount exceeds 85%, the ductility tends to be reduced.

In the Co-base alloy of the present invention, the component and composition are specified in order to disperse an appropriate amount of the intermetallic compound of the $Ll_2$-type [$Co_3$(Al,W)] or [$(Co,X)_3$(Al,W,Z)]. The Co-base alloy of the present invention has a basic composition which includes, in terms of mass proportion, 0.1 to 10% of Al, 3.0 to 45% of W, and Co as the remainder.

Al is a major constituting element of the γ' phase and contributes to the improvement in oxidation resistance. When the content of Al is less than 0.1%, the γ' phase is not precipitated. Even if it is precipitated, it does not contribute to the high temperature strength. However, the content is set to the range of 0.1 to 10% (preferably 0.5 to 5.0%) because the formation of a brittle and hard phase is facilitated by an excessive amount of Al.

W is a major constituting element of the γ' phase and also has an effect of solid solution strengthening of the matrix. When the content of W is less than 3.0%, the γ' phase is not precipitated. Even if it is precipitated, it does not contribute to the high temperature strength. When an additive amount of W exceeds 45%, the formation of a harmful phase is facilitated. For that reason, W content is set to the range of 3.0 to 45% (preferably 4.5 to 30%).

One or more alloy components selected from Group (I) and Group (II) are added to a basic component system of Co—W—Al, if necessary. In the case where a plurality of alloy components selected from Group (I) are added, the total content is selected from the range of 0.001 to 2.0%. In the case where a plurality of alloy components selected from Group (II) are added, the total content is selected from the range of 0.1 to 50%.

Group (I) is the group consisting of B, C, Y, La, and misch metal.

B is an alloy component which is segregated in the crystal grain boundary to enhance the grain boundary and contributes to the improvement in the high temperature strength. When the content of B is 0.001% or more, the additive effect becomes significant. However, the excessive amount is not preferable in view of the processability, and therefore the upper limit is set to 1% (preferably 0.5%). As with B, C is effective in enhancing the grain boundary. Further, it is precipitated as carbide, thereby improving the high temperature strength. Such an effect is observed when 0.001% or more of C is added. However, the excessive amount is not preferable in view of the processability and toughness, and therefore the upper limit of C is set to 2.0% (preferably 1.0%). Y, La, and misch metal are components effective in improving the oxidation resistance. When the content thereof is 0.01% or more, their additive effects are produced. However, an excessive amount thereof has an adverse effect on the textural stability, and therefore each of the upper limits is set to 1.0% (preferably 0.5%).

Group (II) is the group consisting of Ni, Cr, Ti, Fe, V, Nb, Ta, Mo, Zr, Hf, Ir, Re, and Ru. As for alloy components of Group (II), a large distribution coefficient of the element is more effective in stabilizing the γ' phase. The distribution coefficient $K_x^{\gamma'/\gamma}$ is represented by $K_x^{\gamma'/\gamma}=C_x^{\gamma'}/C_x^{\gamma}$ [provided that $C_x^{\gamma'}$: concentration of element x in γ' phase (atomic %), $C_x^{\gamma'}$: concentration of element x in matrix (γ) phase (atomic %)] and it shows the ratio of concentration of a predetermined element contained in γ' phase to a predetermined element contained in the matrix phase. If the distribution coefficient is 1 or more, it shows a γ' phase stabilized element. If the distribution coefficient is less than 1, it shows the matrix phase stabilized element (FIG. 1). Ti, V, Nb, Ta, and Mo are the γ' phase stabilized elements. Among them, Ta is the most effective element.

Ni and Iris substituted by Co of the $Ll_2$-type intermetallic compound and is a component which improves the heat resistance and corrosion resistance. When the content of Ni is 1.0% or more and the content of Ir is 1.0% or more, the additive effects are observed. However, an excessive amount thereof causes the formation of a phase of hazardous compound, and thus the upper limits of Ni and Ir are set to 50% (preferably 40%) and 50% (preferably 40%), respectively. Ni is substituted by Al and W, can improve the stability of the γ' phase, and can maintain the stable state of the γ' phase at higher temperatures.

Fe is also substituted by Co and has an effect of improving processability. When the content of Fe is 1.0% or more, the additive effect becomes significant. However, the excessive amount, more than 10%, is responsible for the instability of texture, and thus the upper limit of Fe is set to 10% (preferably 5.0%).

Cr forms a fine oxide film on the surface of the Co-base alloy and is an alloy component which improves the oxidation resistance. Additionally, it contributes to the improvement in the high temperature strength and corrosion resistance. When the content of Cr is 1.0% or more, such an effect becomes significant. However, the excessive amount causes the processing deterioration, and thus the upper limit of Cr is set to 20% (preferably 15%).

Mo is an effective alloy component for the stabilization of the γ' phase and solid solution strengthening of the matrix. When the content of Mo is 1.0% or more, the additive effect is observed. However, the excessive amount causes the processing deterioration, and thus the upper limit of Mo is set to 15% (preferably 10%).

Re and Ru are components effective in improving the oxidation resistance. When the content thereof is 0.5% or more, the additive effects become significant. However, an excessive amount thereof causes inducing the formation of a harmful phase, and thus the upper limits of Re and Ru are set to 10% (preferably 5.0%).

Ti, Nb, Zr, V, Ta, and Hf are effective alloy components for the stabilization of the γ' phase and the improvement in the high temperature strength. When the content of Ti is 0.5% or more, the content of Nb is 1.0% or more, the content of Zr is 1.0% or more, the content of V is 0.5% or more, the content of Ta is 1.0% or more, and the content of Hf is 1.0% or more, the additive effects are observed. However, an excessive amount thereof causes the formation of harmful phases and the melting point depression, and thus the upper limits of Ti, Nb, Zr, V, Ta, and Hf are set to 10%, 20%, 10%, 10%, 20%, and 10%, respectively.

In the case where the Co-base alloy, which is adjusted to a predetermined composition, is used as a casting material, it is produced by any method such as usual casting, unidirectional coagulation, squeeze casting, and single crystal method. It can be hot-worked at a solution treatment temperature and has a relatively good cold-working property. Therefore it can also be processed into a plate, bar, wire rod, and the like.

The Co-base alloy is formed into a predetermined shape and then heated in the solution treatment temperature range of 1100 to 1400° C. (preferably 1150 to 1300° C.). The strain introduced by processing is removed and the precipitate is solid-solutioned in the matrix in order to homogenize the material. When the heating temperature is below 1100° C., neither the removal of strain nor the solid solution of precipitate proceeds. Even if both of them proceed, it takes a lot of time, which is not productive. On the other hand, when the heating temperature exceeds 1400° C., some liquid phase is formed and the roughness of the crystal grain boundary and the coarsening growth of the crystal grains are facilitated, which results in reducing the mechanical strength.

The Co-base alloy is subjected to solution treatment, followed by aging treatment. In the aging treatment, the Co-base alloy is heated in the temperature range of 500 to 1100° C. (preferably 600 to 100° C.) to precipitate $Co_3(Al,W)$. $Co_3(Al,W)$ is the $Ll_2$-type intermetallic compound and the lattice constant mismatch between $Co_3(Al,W)$ and the matrix is small. It is excellent in the high temperature stability as compared to the γ' phase [$Ni_3(Al,Ti)$ of the Ni-base alloy and contributes to the improvement in the high temperature strength and heat resistance of the cobalt-base alloy. $(Co,X)_3(Al,W,Z)$ in the component system to which an alloy component of Group (II) is added contributes to the improvement in the high temperature strength and heat resistance of the cobalt-base alloy.

As for a γ' phase with a $Ll_2$ structure which is used as a strengthening phase, γ' $Ni_3Al$ phase is a stable phase in an equilibrium diagram of Ni—Al binary system. Thus, in the Ni-base alloy using this system as a basic system, the γ' phase has been used as a strengthening phase. In an equilibrium diagram of Co—Al system, $Co_3Al$ phase is not present and it is reported that the γ' phase is a metastable phase. It is necessary to stabilize the metastable γ' phase in order to use the γ' phase as a strengthening phase of the Co-base alloy. In the present invention, the stabilization of the metastable γ' phase is achieved by adding W. It is considered that γ' $Ll_2$ phase (composition ratio: $Co_3(Al, W)$ or $(Co,X)_3(Al,W,Z)$) is precipitated as a stable phase.

It is preferable that the intermetallic compound [$Co_3(Al, W)$] or [$(Co,X)_3(Al,W,Z)$] is precipitated on the matrix under conditions where the particle diameter is 50 nm to 1 μm and the precipitation amount is about 40 to 85% by volume. Precipitation-strengthening effect is obtained when the particle diameter of the precipitate is 10 nm or more. However, the precipitation-strengthening effect is reduced when the particle diameter exceeds 1 μm. For the purpose of obtaining sufficient precipitation-strengthening effect, it is required that the precipitation amount is 40% by volume or more. However, when the precipitation amount exceeds 85% by volume, the ductility tends to be lowered. In order to give a preferable particle diameter and precipitation amount, it is preferable that the aging treatment is performed gradually in a predetermined temperature region.

As for the prices of metal materials themselves, Co is more expensive than Ni. In many cases, the manufacturing/processing cost accounts for a large percentage of the actual price. For example, in the case of the Ni-base alloy turbine blade, the material cost is estimated about 5% of the total cost. Even if the expensive Co is used, the extra material cost is only several percent of the total cost. Taking into consideration advantages of the increase in the working temperature of a heat engine and a longer operating life, it is considered that the Co is sufficient for practical use. Therefore, taking advantage of an excellent high temperature characteristic, it contemplated that the member conventionally made with the Co-base heat-resistant alloy is highly strengthened and an alternate application where the member made with the Ni-base alloy is used is also expected. Specifically, it can be used as a suitable material for gas turbine members, engine members for aircraft, chemical plant materials, engine members for automobile such as turbocharger rotors, and high temperature furnace materials etc. Since it has the high strength as well as the high elasticity and is excellent in corrosion resistance, it can be used as a material for build-up materials, spiral springs, springs, wires, belts, cable guides, and the like.

Example 1

The Co-base alloy with the composition of Table 1 was smelted by high-frequency-induction dissolution in an inert gas atmosphere. The resulting product was casted to form an ingot, and then hot-rolled to a plate thickness of 3 mm at 1200° C. The test pieces obtained from the ingot and the hot-rolled plate were subjected to the solution treatment and aging treatment shown in Table 2, followed by texture observation, composition analysis, and characteristic test.

Each of the test results is shown in Table 3. In the Table, γ'/$D0_{19}$ shows that precipitates are two types of γ' phase and $D0_{19}(Co_3W)$ phase, $D0_{19}$/μ shows that precipitates are two types of $D0_{19}$ phase and μ phase, and B2/μ shows that precipitates are two types of B2 (CoAl) phase and μ phase.

In the samples of Test Nos. 1 to 13, one type of the γ' phase was observed as a precipitate. As is apparent from the case of Test Nos. 1 and 2, it is found that a mechanical property such as hardness can be controlled by changing the precipitation amount of the γ' phase in the aging treatment even if the alloy has the same composition. When the γ' amount is extremely increased, the ductility at room temperature tends to be lowered (Test Nos. 9 to 12). Vickers hardness at 800° C. is as sufficiently-high as about 300 and good high temperature characteristics are obtained. Alloy No. 3 is an alloy design that values compatibility between the strength and the ductility. In Examples 2 and 3 described below, Alloy No. 3 is used as a basic composition.

In Test Nos. 14 to 19, the precipitates of $D0_{19}$ phase and B2 phase etc. were detected in addition to the γ' phase. The precipitates of $D0_{19}$ phase and B2 phase etc. were preferentially precipitated in the crystal grain boundary and the γ' phase was precipitated in the grain. The high hardness of the grains was maintained up to an elevated temperature due to the precipitation form in the grain boundary and the grains. However, the elongation at break at room temperature was reduced.

The Co-base alloys in Test Nos. 13 and 14 had the same composition. However, $D0_{19}$ phase was not precipitated in the case of Test No. 13 because of a short time heat treatment and a relatively large elongation was observed. Thus, only γ' phase can be precipitated by a short-time aging treatment and it can be applied to members to be used at a relatively low temperature.

Test Nos. 20 and 21 show the characteristics of Alloy Nos. 12 and 13 (comparative materials). In these alloys, the γ' phase was not precipitated. The precipitation of a very weak μ phase resulted in the hardness, while the ductility was extremely poor.

TABLE 1

Smelted cobalt-base alloy (Co; impurities removed from the remainder)

| Classification | Alloy No. | Alloy component (% by mass) Al | W |
|---|---|---|---|
| Example of the present invention | 1 | 3.7 | 21.1 |
| | 2 | 3.5 | 26.8 |
| | 3 | 3.7 | 24.6 |
| | 4 | 3.6 | 27.3 |
| | 5 | 3.5 | 30.0 |
| | 6 | 1.9 | 26.3 |

TABLE 1-continued

Smelted cobalt-base alloy (Co; impurities removed from the remainder)

| Classification | Alloy No. | Alloy component (% by mass) Al | W |
|---|---|---|---|
| | 7 | 0.5 | 40.9 |
| | 8 | 1.5 | 30.3 |
| | 9 | 2.8 | 31.9 |
| | 10 | 4.4 | 14.8 |
| | 11 | 7.5 | 5.0 |
| Comparative example | 12 | 3.1 | 52.8 |
| | 13 | 13.1 | 29.7 |

TABLE 2

Heat treatment conditions

| Heat treatment No. | Solution treatment (° C.) | (Time) | Aging treatment (° C.) | (Time) |
|---|---|---|---|---|
| 1 | 1300 | 2 | 100 | 168 |
| 2 | 1300 | 2 | 900 | 138 |
| 3 | 1300 | 2 | 900 | 1 |
| 4 | 1300 | 2 | 900 | 168 |
| 5 | 1300 | 2 | 900 | 96 |
| 6 | 1400 | 1 | 900 | 1 |
| 7 | 1400 | 1 | 800 | 96 |

TABLE 3

Alloy components, metal compositions in accordance with heat treatment conditions, and physical properties

| Test No. | Alloy No. | Heat treatment No. | Precipitated intermetallic compound Type | Precipitation amount (volume %) | strength (MPa) | strength (MPa) | Elongation at break (%) | Vickers hardness (25° C.) | (800° C.) | Oxidation resistance |
|---|---|---|---|---|---|---|---|---|---|---|
| 1 | 1 | 4 | Y' | 49 | 1310 | 975 | 23 | 467 | 290 | Δ |
| 2 | 1 | 2 | Y' | 30 | 1044 | 668 | 25 | 327 | 225 | Δ |
| 3 | 2 | 4 | Y' | 75 | 1335 | 951 | 12 | 484 | 331 | ○ |
| 4 | 3 | 1 | Y' | 10 | 758 | 542 | 25 | 268 | 226 | Δ |
| 5 | 3 | 2 | Y' | 50 | 1214 | 834 | 17 | 422 | 309 | ○ |
| 6 | 3 | 3 | Y' | 65 | 1085 | 737 | 21 | 385 | — | ○ |
| 7 | 3 | 4 | Y' | 65 | 1345 | 995 | 11 | 481 | 310 | ○ |
| 8 | 3 | 5 | Y' | 65 | 1320 | 971 | 14 | 473 | 308 | ○ |
| 9 | 4 | 6 | Y' | 75 | 660 | 650 | 0.5 | 360 | — | ○ |
| 10 | 4 | 7 | Y' | 75 | 702 | 671 | 4 | 457 | 292 | ○ |
| 11 | 5 | 6 | Y' | 80 | 590 | 520 | 4 | 336 | — | Δ |
| 12 | 5 | 7 | Y' | 80 | 674 | 629 | 3 | 426 | 324 | Δ |
| 13 | 6 | 3 | Y' | 40 | 940 | 676 | 16 | 305 | — | Δ |
| 14 | 6 | 4 | Y'/$D0_{19}$ | 70 | 1197 | 922 | 8 | 450 | 305 | Δ |
| 15 | 7 | 4 | Y'/$D0_{19}$ | 55 | 935 | 822 | 6 | 525 | 335 | Δ |
| 16 | 8 | 4 | Y'/$D0_{19}$ | 65 | 1026 | 862 | 8 | 483 | 301 | Δ |
| 17 | 9 | 4 | Y'/$D0_{19}$ | 85 | 765 | 716 | 4 | 432 | 278 | ○ |
| 18 | 10 | 4 | Y'/B2 | 25 | 658 | 619 | 4 | 305 | 197 | ○ |
| 19 | 11 | 4 | Y'/B2 | 10 | 652 | 631 | 2 | 412 | 220 | ○ |
| 20 | 12 | 2 | $D0_{19}$/μ | — | 421 | — | <0.1 | 478 | — | X |
| 21 | 13 | 2 | B2/μ | — | 220 | — | <0.1 | 671 | — | ○ |

Figure 2:
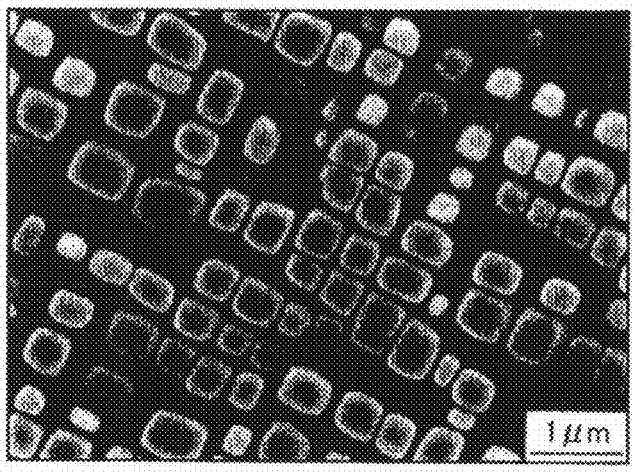
FIG. 2 is a SEM image showing a texture of aging materials of Co-3.6Al-27.3W alloy.
Figure 3:
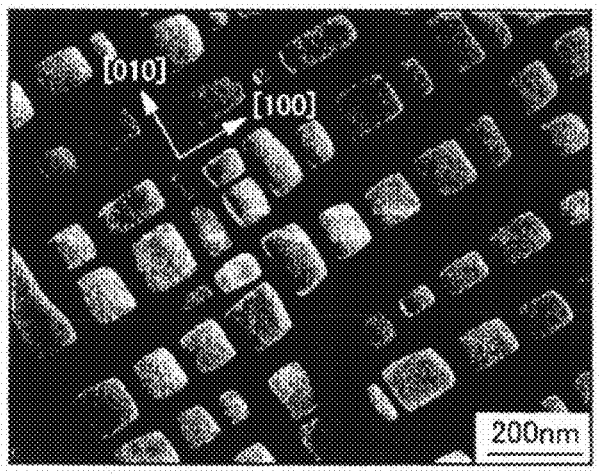
FIG. 3 is a TEM image showing a two-phase texture of aging materials of Co-3.7Al-21.1W alloy.
Figure 4:
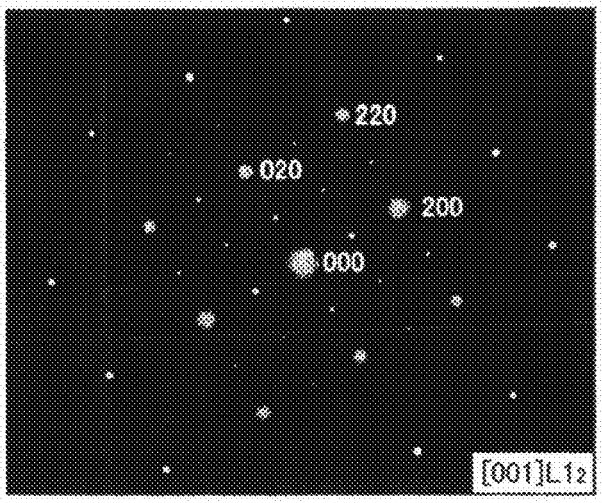
FIG. 4 is an electron diffraction pattern showing $Ll_2$-type structure of aging materials of Co-3.7Al-21.1W alloy.

FIG. 2 is a SEM image of Alloy No. 4 which was subjected to aging treatment at 1000° C. for 168 hours. As shown in FIG. 2, fine precipitates having the cubic shape were uniformly dispersed and had the same texture as the Ni-base superalloy conventionally used. As also shown in a TEM image of Alloy No. 1 which was subjected to aging treatment at 900° C. for 72 hours (FIG. 3), fine precipitates having the cubic shape were uniformly dispersed. From an electronic diffraction image (FIG. 4), they were identified as precipitates with the $Ll_2$-type crystal structure.

The precipitates that were precipitated by aging treatment had a characteristic unlikely to be coarsened. Even after heat treatment at 800° C. for 600 hours, an average particle diameter was 150 nm or less. The characteristic unlikely to be coarsened indicated that the stability of texture was good. Such a uniform precipitation of the $Ll_2$ phase was not detected in Comparative examples.

Figure 5:
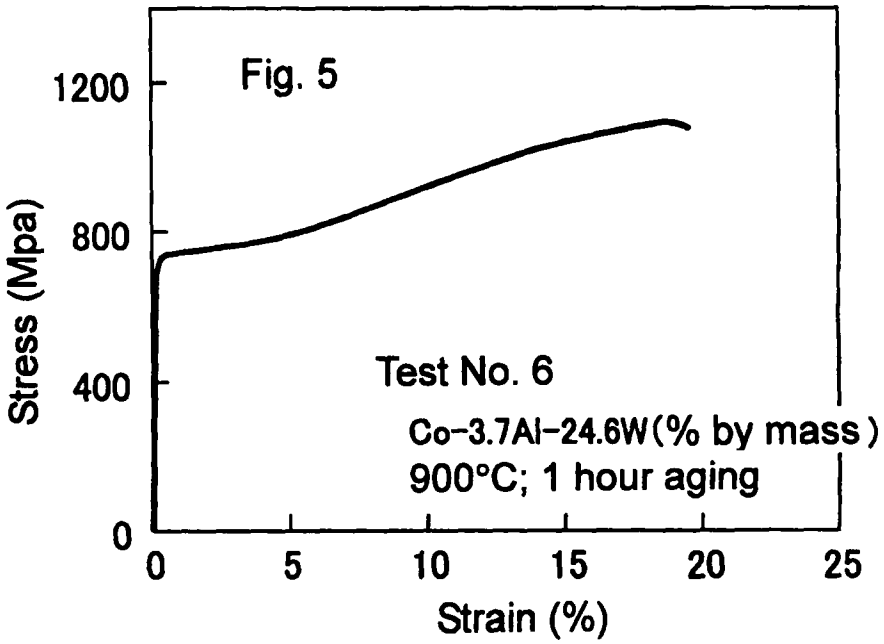
FIG. 5 is a graph showing a stress-strain curve of aging materials of Co-3.7Al-24.6W alloy.

As shown in the stress-strain curve (FIG. 5), the mechanical properties of Alloy No. 3 are as follows: tensile strength: 1085 MPa, 0.2% proof strength: 737 MPa, and elongation at break: 21%. The mechanical properties were the same as that of the Ni-base alloy such as Waspaloy or more than that. However, when the γ' phase fraction becomes large, the ductility tends to be lowered. Thus, it is preferable to adjust the γ' phase fraction to the range of 40 to 85% by volume.

Figure 6:
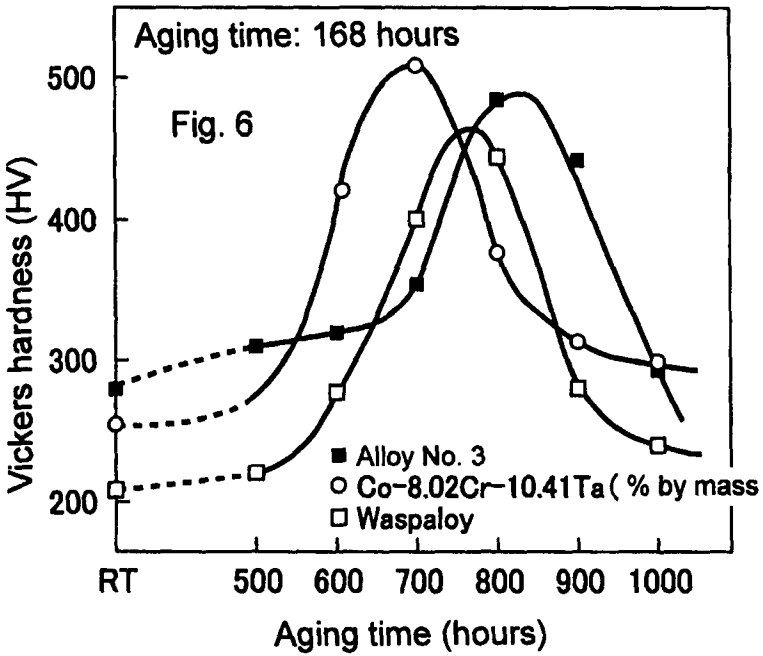
FIG. 6 is a graph showing the aging temperature dependence of Vickers hardness.
Figure 7:
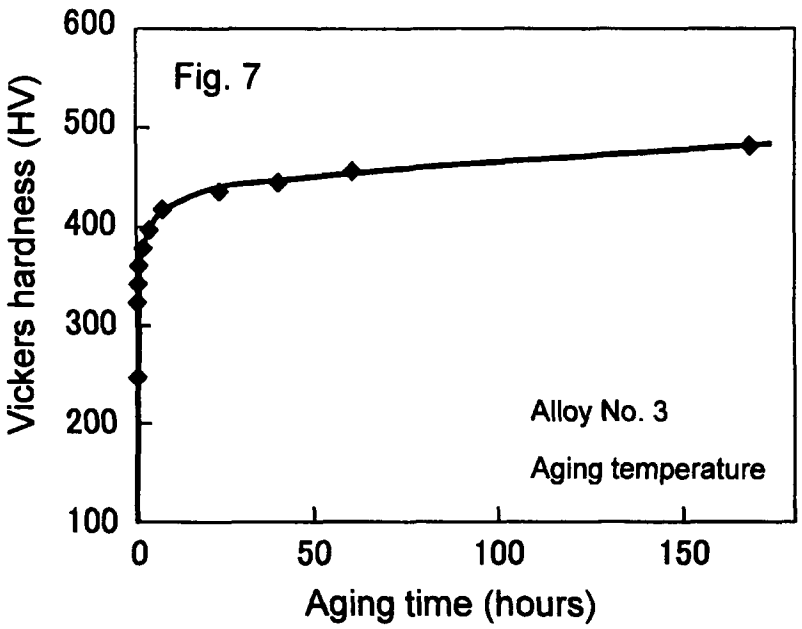
FIG. 7 is a graph showing the aging time dependence of Vickers hardness.

As is apparent from the aging time dependence of Vickers hardness (FIG. 6) as well as the aging time dependence of Vickers hardness (FIG. 7), the increase of hardness by aging for 168 hours was significant at 700 to 900° C. in the case of Alloy No. 3. In the case of the heating temperature exceeding 900° C., the precipitates are coarsened. On the other hand, in the case of the heating temperature less than 600° C., the precipitates are insufficient. It is surmised that both cases cause for preventing the alloy from being hardened. In addition, the hardness of Co—Cr—Ta alloy and Waspaloy are also shown in FIG. 6 for comparison. A peak of hardness as to Alloy No. 3 was observed at higher temperatures as compared to the others. The increase of hardness, in other words, the precipitation of the γ' phase, proceeded very rapidly up to about 5 hours. As is found in FIG. 7, the increase proceeded gradually after 5 hours.

Example 2

Table 4 shows alloy designs in which alloy components of Group (I) were added to Co—W—Al alloy. The amounts of Al and W were determined based on Alloy No. 3 of Table 1. The cobalt-base alloy adjusted to a predetermined composition was dissolved, casted, and hot-rolled in the same manner as described in Example 1, followed by heat-treating. The characteristics of the obtained hot-rolled plates are shown in Table 5.

TABLE 4

Smelted cobalt-base alloy (Co; impurities removed from the remainder)

| | Alloy component and content (% by mass) | | | | | |
|---|---|---|---|---|---|---|
| Alloy No. | Al | W | B | C | Y | La |
| 14 | 3.7 | 25.0 | 0.2 | — | — | — |
| 15 | 3.7 | 25.0 | — | 0.7 | — | — |
| 16 | 3.7 | 25.0 | — | — | 0.4 | — |
| 17 | 3.7 | 25.0 | — | — | — | 0.4 |
| 18 | 3.7 | 25.0 | 0.03 | 0.03 | — | — |

Since all components other than C were added trace elements in Group (I), a major change in the texture other than the addition of C was not observed. When a carbide is precipitated by addition of C, the Co-base alloy becomes hard. Both C and B tend to be segregated in the grain boundary segregation and they contribute to the improvement in high temperature creep strength. When the mechanical properties at room temperature was observed, 0.2% proof strength was increased as compared to Alloy No. 3 (ternary alloy). However, the elongation at break was reduced and the tensile strength showed an approximate equivalent value. It is known that the addition of Y and La is effective in improving the oxidation resistance of the Ni-base alloy. The same effect is also observed in the component system of the present invention. In addition, the elements of Group (I) does not have a substantial adverse influence on the stability and mechanical properties of the γ' phase, and therefore it can be expected as a very effective additive component.

TABLE 5

Alloy components, metal compositions in accordance with heat treatment conditions, and physical properties

| Test No. | Alloy No. | Heat treatment No. | Precipitated intermetallic compound Type | Precipitation amount (volume %) | strength (MPa) (MPa) | strength (MPa) (MPa) | Elongation at break (%) | Vickers hardness (25° C.) | Vickers hardness (800° C.) | Oxidation resistance |
|---|---|---|---|---|---|---|---|---|---|---|
| 22 | 14 | 4 | Y' | 60 | 1366 | 1018 | 10 | 487 | 282 | ○ |
| 23 | 15 | 4 | Y'/Carbide | 45 | 1228 | 1095 | 8 | 625 | 346 | ○ |
| 24 | 16 | 4 | Y' | 60 | 1310 | 918 | 15 | 445 | 280 | ◎ |
| 25 | 17 | 4 | Y' | 60 | 1339 | 934 | 15 | 461 | 277 | ◎ |
| 26 | 18 | 4 | Y' | 60 | 1244 | 1035 | 7 | 488 | 296 | ○ |

Example 3

Table 6 shows alloy designs in which alloy components of Group (II) were added to Co—W—Al alloy. The Co-base alloy adjusted to a predetermined composition was dissolved, casted, and hot-rolled in the same manner as described in Example 1, followed by heat-treating. The characteristics of the obtained hot-rolled plates are shown in Table 7. For comparison, physical properties of Ni-base super alloy Waspaloy (Cr: 19.5%, Mo: 4.3%, Co: 13.5%, Al: 1.4%, Ti: 3%, C: 0.07%) are shown in Table 7 as Alloy No. 33.

TABLE 6

| Smelted cobalt-base alloy (Co; impurities removed from the remainder) | | | |
|---|---|---|---|
| | Alloy component and content (% by mass) | | |
| Alloy No. | Al | W | Alloy component of Group (II) |
| 19 | 4.0 | 26.9 | Ni: 4.3 |
| 20 | 3.4 | 25.4 | Ir: 5.4 |
| 21 | 3.5 | 26.4 | Fe: 1.6 |
| 22 | 3.5 | 26.4 | Cr: 1.5 |
| 23 | 3.4 | 26.1 | Mo: 2.8 |
| 24 | 3.4 | 25.4 | Re: 5.3 |
| 25 | 3.5 | 26.4 | Ti: 1.4 |
| 26 | 3.4 | 26.1 | Zr: 2.6 |
| 27 | 3.4 | 25.5 | Hf: 5.0 |
| 28 | 3.5 | 26.4 | V: 1.5 |
| 29 | 3.4 | 26.1 | Nb: 2.7 |
| 30 | 3.4 | 25.4 | Ta: 5.1 |
| 31 | 3.6 | 23.9 | Cr: 3.7, Ta: 5.2 |
| 32 | 3.8 | 26.0 | Ni: 16.6, Ta: 5.1 |

No. 32 had the nearly same hardness as that of Alloy No. 3 (ternary alloy) at room temperature immediately after the aging treatment. The γ' phase was stable up to an elevated temperature, and thus the hardness was hardly decreased at high temperature and a value comparable to that of Alloy No. 30 was observed at 1000° C.

Figure 10:
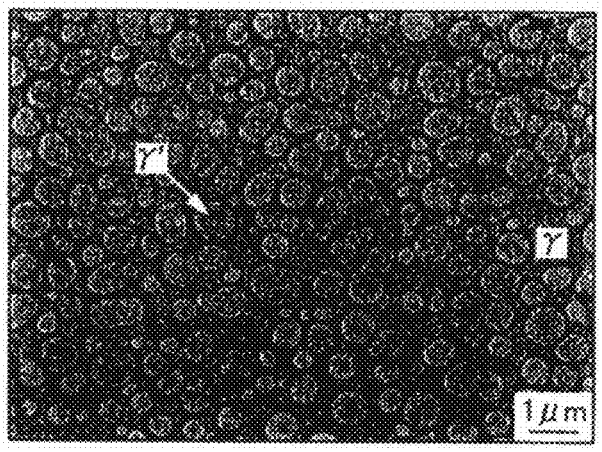
FIG. 10 is a SEM image showing a two-phase (γ+γ') texture of Co—Al—W alloy in which spherical precipitates are formed by adding Mo.
Figure 11:
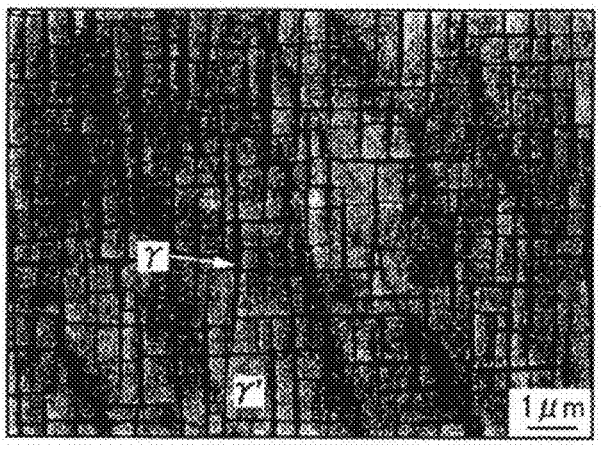
FIG. 11 is a SEM image showing a two-phase (γ+γ') texture of Co—Al—W alloy in which cubic precipitates are formed by adding Ta.

Two-phase (γ+γ') textures of Alloy No. 23 and Alloy No. 30, which were subjected to aging treatment at 1000° C. for 168 hours, was shown in FIGS. 10 and 11, respectively. In Alloy No. 23 to which Mo was added, the γ' phase was spheroidized. In Alloy No. 30 to which Ta was added, the γ' phase having the cubic shape was precipitated. The difference in the precipitation form derives from the difference in lattice constant (lattice mismatch) between the matrix (γ phase) and the γ' phase and it has also a large effect on the high temperature characteristics of the materials. In the present component system, the precipitation form can be changed by a very small amount of additive elements. Thus, various alloy designs according to applications and the texture control can be achieved.

In Group (II), Fe and Cr which are matrix (γ) stabilized elements cause the reduction of precipitation amount of the γ'

TABLE 7

| Alloy components, metal compositions in accordance with heat treatment conditions, and physical properties | | | | | | | | | | |
|---|---|---|---|---|---|---|---|---|---|---|
| | | Heat | Precipitated intermetallic compound | | strength | strength | Elongation | Vickers | | |
| Test | Alloy | treatment | | Precipitation amount | (MPa) | (MPa) | at break | hardness | | Oxidation |
| No. | No. | No. | Type | (volume %) | (MPa) | (MPa) | (%) | (25° C.) | (800° C.) | resistance |
| 27 | 19 | 4 | Y' | 65 | 13.7 | 874 | 24 | 460 | 320 | ○ |
| 28 | 20 | 4 | Y' | 60 | 1395 | 920 | 18 | 510 | 345 | ◎ |
| 29 | 21 | 4 | Y'/B2 | 45 | 1180 | 772 | 12 | 406 | 287 | ○ |
| 30 | 22 | 4 | Y'/$D0_{19}$ | 35 | 1136 | 790 | 16 | 411 | 290 | ◎ |
| 31 | 23 | 4 | Y'/$D0_{19}$ | 40 | 1319 | 836 | 16 | 452 | 311 | ○ |
| 32 | 24 | 4 | Y' | 60 | 1402 | 870 | 20 | 455 | 310 | ◎ |
| 33 | 25 | 4 | Y' | 70 | 1221 | 756 | 24 | 442 | 309 | Δ |
| 34 | 26 | 4 | Y'/$D0_{19}$ | 75 | 1252 | 813 | 12 | 421 | 280 | Δ |
| 35 | 27 | 4 | Y'/$D0_{19}$ | 75 | 1240 | 922 | 9 | 488 | 338 | ○ |
| 36 | 28 | 4 | Y' | 70 | 1203 | 790 | 18 | 415 | 383 | Δ |
| 37 | 29 | 4 | Y'/$D0_{19}$ | 70 | 1186 | 804 | 13 | 421 | 310 | ○ |
| 38 | 30 | 4 | Y'/$D0_{19}$ | 75 | 1365 | 955 | 14 | 531 | 390 | ○ |
| 39 | 31 | 4 | Y'/$D0_{19}$ | 65 | 1371 | 952 | 15 | 503 | 307 | ◎ |
| 40 | 32 | 4 | Y' | 70 | 1410 | 920 | 20 | 385 | 335 | ◎ |
| 41 | 33 | — | Y' | 48 | 1275 | 795 | 25 | 410 | 309 | ◎ |

Figure 8:
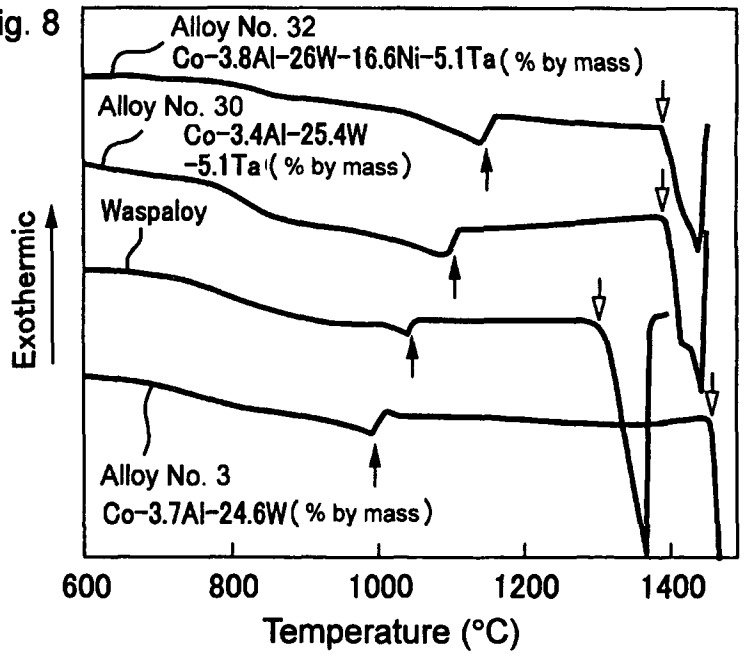
FIG. 8 is a graph of DSC curves showing phase changes in Co—Al—W ternary alloy, Ta-added Co—Al—W alloy, Co—Ni—Al—W alloy, and Waspaloy.

DSC curves of Alloy No. 3, Alloy No. 30, Alloy No. 32, and Alloy No. 33 (Waspaloy) are shown in FIG. 8. As for Alloy No. 30, the γ' solid solution temperature indicated by black arrows was highly increased as compared to that of the ternary alloy to which Ta was added. It is found that the γ' phase was stably present up to a temperature higher than that of Waspaloy. It can be understand that Alloy Nos. 3 and 30 are more excellent in heat resistance in comparison with that of Alloy No. 33 from the fact that the solidus temperature indicated by white arrows (temperature where a liquid phase is formed) is high. Alloy No. 32 is an alloy that a part of Co in Alloy No. 30 is substituted by Ni. The γ' solid solution temperature was further increased and the solidus temperature was hardly reduced.

Figure 9:
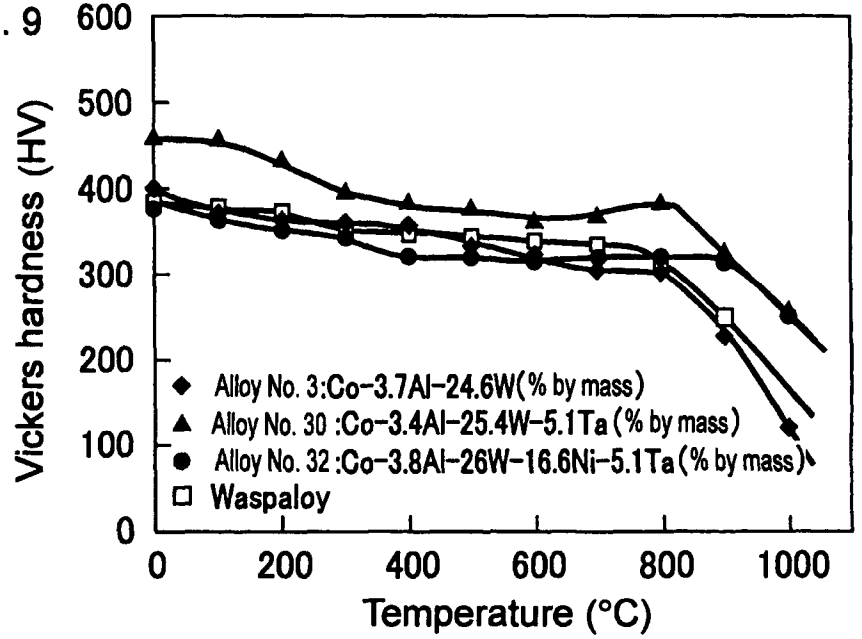
FIG. 9 is a graph showing the relation between hardness and temperature in Co—Al—W ternary alloy, Ta-added Co—Al—W alloy, Co—Ni—Al—W alloy, and Waspaloy.

The results of measurement of the high temperature hardness of alloy Nos. 3, 30, 32, and 33 are shown in FIG. 9. Alloy No. 3 had the same hardness as that of Alloy No. 33, while Alloy No. 30 to which Ta was added showed hardness higher than that of Alloy No. 33 in the temperature range of room temperature to 1000° C. Its mechanical properties were superior to the conventional Ni-base alloy. As a result, it can be said that it is a very promising heat-resistant material. Alloy phase and the decrease of the solid solution temperature. Since Cr has a significant effect on the improvement of the oxidation resistance and the corrosion resistance, it can be said that it is an essential element from a practical standpoint. In the aging treatment, the precipitation of a brittle and hard B2 (CoAl) phase is facilitated by Fe, which causes the decrease in the ductility. When Fe is in the solution-treated state, it conversely contributes to the improvement in the processability. Thus, the additive amount is adjusted in accordance with the intended use.

Figure 12:
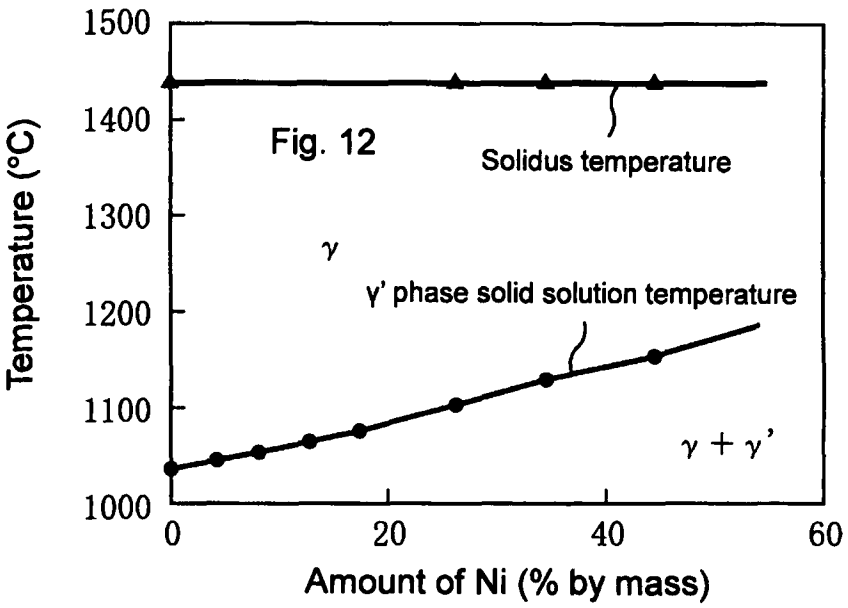
FIG. 12 is a graph showing an effect of addition of Ni on the transformation temperature of Co—Al—W alloy.

The distribution coefficient of Ni is nearly 1 and an equivalent amount of Ni is distributed on the matrix and the precipitates. However, the research results by the present inventors indicate that the solid solution temperature of the γ phase rises with increased amounts of Ni while the solidus temperature hardly decreases, as shown in the solid solution temperature and the solidus temperature of the γ' phase of Co-4Al-26.9W ternary system alloy to which various amounts of Ni were added (FIG. 12). This corresponds to the result of Alloy No. 32 whose hardness is gradually decreased at high temperature by adding Ni and which has an excellent high temperature characteristic.

With reference to Alloy No. 20 to which Ir was added, the hardness and tensile strength at room temperature were increased in addition to the oxidation resistance. The oxidation resistance of Alloy No. 24 was improved by adding Re, while the obtained mechanical properties were not as effective as that of Ir.

All elements of Groups 4 and 5 such as Ti, Zr, Hf, V, and Nb stabilize the γ' phase and increase the precipitation amount, and therefore they impart a good characteristic to the phase at both room temperature and high temperature. However, they have a role in facilitating the precipitation of $D0_{19}$ ($Co_3W$) phase. Although the $D0_{19}$ phase does not have adverse influence on the ductility like the B2 phase, it is easily coarsened as compared to the γ phase. Thus, it is necessary to control the additive amount in an actual alloy design.

Alloy Nos. 31 and 32 are cobalt-base alloys with combined addition of Cr and Ta and combined addition of Ni and Ta, respectively. Both alloys were excellent in the oxidation resistance and had a high temperature hardness equal to that of Waspaloy alloy as well as a sufficient ductility.

The invention claimed is:

1. A cobalt-base alloy with high heat resistance and high strength comprising: in a cobalt-base alloy comprising a composition of, in terms of mass proportion, 0.1 to 10% of Al, 3.0 to 45% of W, and Co as a remainder containing indispensable impurities, a metal texture in which a $Ll_2$-type intermetallic compound (γ' phase) of $Co_3$(Al, W) by atom ratio is precipitated, the $Ll_2$-type intermetallic compound is precipitated under conditions where the particle diameter is 10 nm to 1 μm and the precipitation amount is 40 to 85% by volume, and the mismatch of the lattice constant between the γ' phase and matrix (y phase) is 0.5% or less.

2. A cobalt-base alloy with high heat resistance and high strength, produced by the steps of:

solution-treating the cobalt-base alloy with the composition according to claim 1 in the temperature range of 1100-1400° C. for 1-2 hours; and performing aging treatment in the temperature range of 500-1100° C. for 1-168 hours.

3. The cobalt-base alloy with high heat resistance and high strength according to claim 1, further comprising:

one or more components selected from the following Group (I) in a total of 0.001 to 2.0% by mass, wherein Group (I): 0.001 to 1% of B, 0.001 to 2.0% of C, 0.01 to 1.0% of Y, and 0.01 to 1.0% of La or misch metal.

4. A cobalt-base alloy with high heat resistance and high strength produced by the steps of:

solution-treating the cobalt-base alloy with the composition according to claim 3 in the temperature range of 1100-1400° C. for 1-2 hours; and performing aging treatment in the temperature range of 500-1100° C. for 1-168 hours.

5. The cobalt-base alloy with high heat resistance and high strength according to claim 1, further comprising:

one or more components selected from the following Group (II) in a total of 0.1 to 50%;

wherein an $Ll_2$-type intermetallic compound precipitated is $(Co,X)_3(Al,W,Z)$ by atom ratio;

wherein, X is Ir, Fe, Cr, Re, and/or Ru, Z is Mo, Ti, Nb, Zr, V, Ta, and/or Hf, and nickel can be comprised in both X and Z; and Group (II): 50% or less of Ni, 50% or less of Ir, 10% or less of Fe, 20% or less of Cr, 15% or less of Mo, 10% or less of Re, 10% or less of Ru, 10% or less of Ti, 20% or less of Nb, 10% or less of Zr, 10% or less of V, 20% or less of Ta, and 10% or less of Hf.

6. A cobalt-base alloy produced by the steps of:

solution-treating the cobalt-base alloy according to claim 5 in the temperature range of 1100 to 1400° C. for 1 to 2 hours; and performing aging treatment in the temperature range of 800 to 1000° C. for 1 to 168 hours.

7. The cobalt-base alloy with high heat resistance and high strength according to claim 1, further comprising:

one or more components selected from the following Group (I) in a total of 0.001 to 2.0%; and one or more components selected from the following Group (II) in a total of 0.1 to 50%;

wherein the $Ll_2$-type intermetallic compound precipitated is $(Co,X)_3(Al,W,Z)$ by atom ratio; wherein, X is Ir, Fe, Cr, Re, and/or Ru, Z is Mo, Ti, Nb, Zr, V, Ta, and/or Hf, and nickel can be comprised in both X and Z;

Group (I): 0.001 to 1% of B, 0.001 to 2.0% of C, 0.01 to 1.0% of Y, and 0.01 to 1.0% of La or misch metal; and Group (II): 50% or less of Ni, 50% or less of Ir, 10% or less of Fe, 20% or less of Cr, 15% or less of Mo, 10% or less of Re, 10% or less of Ru, 10% or less of Ti, 20% or less of Nb, 10% or less of Zr, 10% or less of V, 20% or less of Ta, and 10% or less of Hf.

8. A cobalt-base alloy with high heat resistance and high strength produced by the steps of:

solution-treating the cobalt-base alloy according to claim 7 in the temperature range of 1100 to 1400° C. for 1 to 2 hours; and performing aging treatment in the temperature range of 800 to 1000° C. for 1 to 168 hours.

* * * * *